US012601363B2

(12) United States Patent
Guo et al.

(10) Patent No.: US 12,601,363 B2
(45) Date of Patent: Apr. 14, 2026

(54) VENTILATION AND HEAT DISSIPATION APPARATUS OF WIND-ASSISTED ROTOR

(71) Applicant: CSIC Shanghai Marine Energy Saving Technology Development Co., LTD, Shanghai (CN)

(72) Inventors: Fengshan Guo, Shanghai (CN); Youhua Wu, Shanghai (CN); Yuzhu Zhu, Shanghai (CN); Zhenyu Huang, Shanghai (CN); Zan Wu, Shanghai (CN); Haochao Xia, Shanghai (CN); Shaofeng Chen, Shanghai (CN); Lu Zhao, Shanghai (CN)

(73) Assignee: CSIC Shanghai Marine Energy Saving Technology Development Co., LTD, Shanghai (CN)

( * ) Notice: Subject to any disclaimer, the term of this patent is extended or adjusted under 35 U.S.C. 154(b) by 368 days.

(21) Appl. No.: 18/037,947

(22) PCT Filed: Mar. 12, 2021

(86) PCT No.: PCT/CN2021/080440

§ 371 (c)(1),
(2) Date: May 19, 2023

(87) PCT Pub. No.: WO2022/105077

PCT Pub. Date: May 27, 2022

(65) Prior Publication Data

US 2023/0407874 A1 Dec. 21, 2023

(30) Foreign Application Priority Data

Nov. 20, 2020 (CN) ..... 202011310324.7

(51) Int. Cl.
*B63J 2/10* (2006.01)
*F04D 29/54* (2006.01)
(Continued)

(52) U.S. Cl.
CPC ..... *F04D 29/541* (2013.01); *B63J 2/10* (2013.01); *F04D 25/08* (2013.01); *F04D 25/12* (2013.01)

(58) Field of Classification Search
CPC ..... F04D 25/08; F04D 25/12; F04D 29/541; B63J 2/02–10; F23J 2211/30; F24F 7/02–025
(Continued)

(56) References Cited

U.S. PATENT DOCUMENTS 2,830,526 A * 4/1958 Breidert ..... F24F 7/02 D23/370
2,933,036 A * 4/1960 Breidert ..... F04D 25/12 454/355
(Continued)

FOREIGN PATENT DOCUMENTS

CN 207118139 U 3/2018
CN 108736328 A 11/2018
(Continued)

OTHER PUBLICATIONS

Fang Xi, International Search Report for PCT/CN2021/080440, China National Intellectual Property Administration as the International Searching Authority, Aug. 18, 2021, 2 pages, Beijing, China.
(Continued)

*Primary Examiner* — Thomas Fink
(74) *Attorney, Agent, or Firm* — William P. Jensen; Crain Caton & James, P.C.

(57) ABSTRACT

A ventilation and heat dissipation apparatus of a wind-assisted rotor includes a cylinder, a top cover, and a rain shielding plate. The top cover is disposed at the top of the cylinder and covers the top of the cylinder, and the top cover is provided with a manhole communicating with an inner cavity of the cylinder. The rain shielding plate is disposed
(Continued)

above the manhole and covers the manhole, and the rain shielding plate and the top cover are spaced apart to form a heat dissipation gap that communicates with an external atmosphere.

12 Claims, 4 Drawing Sheets

(51) Int. Cl.
*F04D 25/08* (2006.01)
*F04D 25/12* (2006.01)

(58) Field of Classification Search
USPC ..... 454/81–82
See application file for complete search history.

(56) References Cited

U.S. PATENT DOCUMENTS

| | | | | |
|---|---|---|---|---|
| 2,962,118 | A * | 11/1960 | Lee | A47L 5/365 55/471 |
| 2,987,983 | A * | 6/1961 | Solzman | F24F 7/025 415/212.1 |
| 3,211,079 | A * | 10/1965 | Carlson | F24H 3/006 126/307 R |
| 6,190,251 | B1 * | 2/2001 | Park | F23L 17/08 454/35 |
| 2010/0068985 | A1 * | 3/2010 | Park | F24F 7/025 454/329 |
| 2016/0280347 | A1 | 9/2016 | Levander et al. | |

FOREIGN PATENT DOCUMENTS

| | | | |
|---|---|---|---|
| CN | 208986460 | U | 6/2019 |
| CN | 208997002 | U | 6/2019 |
| CN | 209282615 | | 8/2019 |
| CN | 209675806 | U | 11/2019 |
| CN | 210111658 | U | 2/2020 |
| CN | 110880705 | A | 3/2020 |
| CN | 111786288 | A | 10/2020 |
| CN | 111846175 | A | 10/2020 |
| CN | 112312748 | A | 2/2021 |
| CN | 213522883 | U | 6/2021 |
| JP | S5863869 | U | 4/1983 |
| JP | H05184097 | A | 7/1993 |
| JP | 2004301094 | A | 10/2004 |
| JP | 2009203700 | A | 9/2009 |
| JP | 2016534942 | A | 11/2016 |
| KR | 20140114525 | A | 9/2014 |
| KR | 102159714 | B1 | 9/2020 |
| TW | 201009272 | A | 3/2010 |
| TW | 1338766 | B | 3/2011 |
| WO | 2009021485 | A2 | 2/2009 |

OTHER PUBLICATIONS

Hou Renjun; First Office Action for CN App. No. 202011310324.7; May 25, 2024; 16 pages; State Intellectual Property Office of People's Republic of China; China.
Ryuhei Miyake; Notice of Reasons for Refusal for JP App. No. 2023-530774; Mar. 26, 2024; 8 pages; Japan Patent Office; Japan.
Hou Renjun; Second Office Action for CN App. No. 202011310324.7; Sep. 28, 2024; 18 pages; State Intellectual Property Office of China; Beijing, China.
Thomas Altmann; European Search Report for EP App. No. 218933235.8; Sep. 17, 2024; 8 pages; European Patent Office; The Hague; NL.

* cited by examiner

VENTILATION AND HEAT DISSIPATION APPARATUS OF WIND-ASSISTED ROTOR

CROSS-REFERENCE TO RELATED APPLICATIONS

This is a national stage application filed under 35 U.S.C. 371 based on International Patent Application No. PCT/CN2021/080440, filed Mar. 12, 2021, which claims priority to Chinese Patent Application No. 202011310324.7 filed Nov. 20, 2020, the disclosure of which is incorporated herein by reference in its entirety.

TECHNICAL FIELD

The present application relates to the field of heat dissipation technology of wind-assisted rotors and, in particular, to a ventilation and heat dissipation apparatus of a wind-assisted rotor.

BACKGROUND

Wind-assisted rotors are typically large in size and require sustained operation at relatively high rotational speeds to provide sustained propulsion for ship sailing. An outer cylinder and an inner tower are generally connected by a bearing, and continuous friction generates a large amount of heat. At the same time, a wind-assisted rotor is usually driven by an electric motor inside the tower. To maintain stability, the electric motor is generally placed at a relatively high position. The overall space inside the tower is relatively closed and limited so that a relatively large amount of heat accumulates inside the tower. A high temperature seriously affects the operation stability of the electric motor, affecting the sustained operation of the rotor. A heat dissipation apparatus of a rotor in the related art is generally provided with no ventilation holes or cannot efficiently perform ventilation and heat dissipation, or a heat dissipation solution is too complex, resulting in increased production costs.

SUMMARY

The present application provides a ventilation and heat dissipation apparatus of a wind-assisted rotor, where the apparatus has a simple structure, a low production cost, and a good ventilation and heat dissipation effect and can prevent rain and snow from entering.

The present application provides a ventilation and heat dissipation apparatus of a wind-assisted rotor, which includes a cylinder, a top cover, and a rain shielding plate.

The top cover is disposed at the top of the cylinder and covers the top of the cylinder, where the top cover is provided with a manhole communicating with an inner cavity of the cylinder.

The rain shielding plate is disposed above the manhole and covering the manhole, where the rain shielding plate and the top cover are spaced apart to form a heat dissipation gap that communicates with the external atmosphere.

REFERENCE LIST

Figure 1:
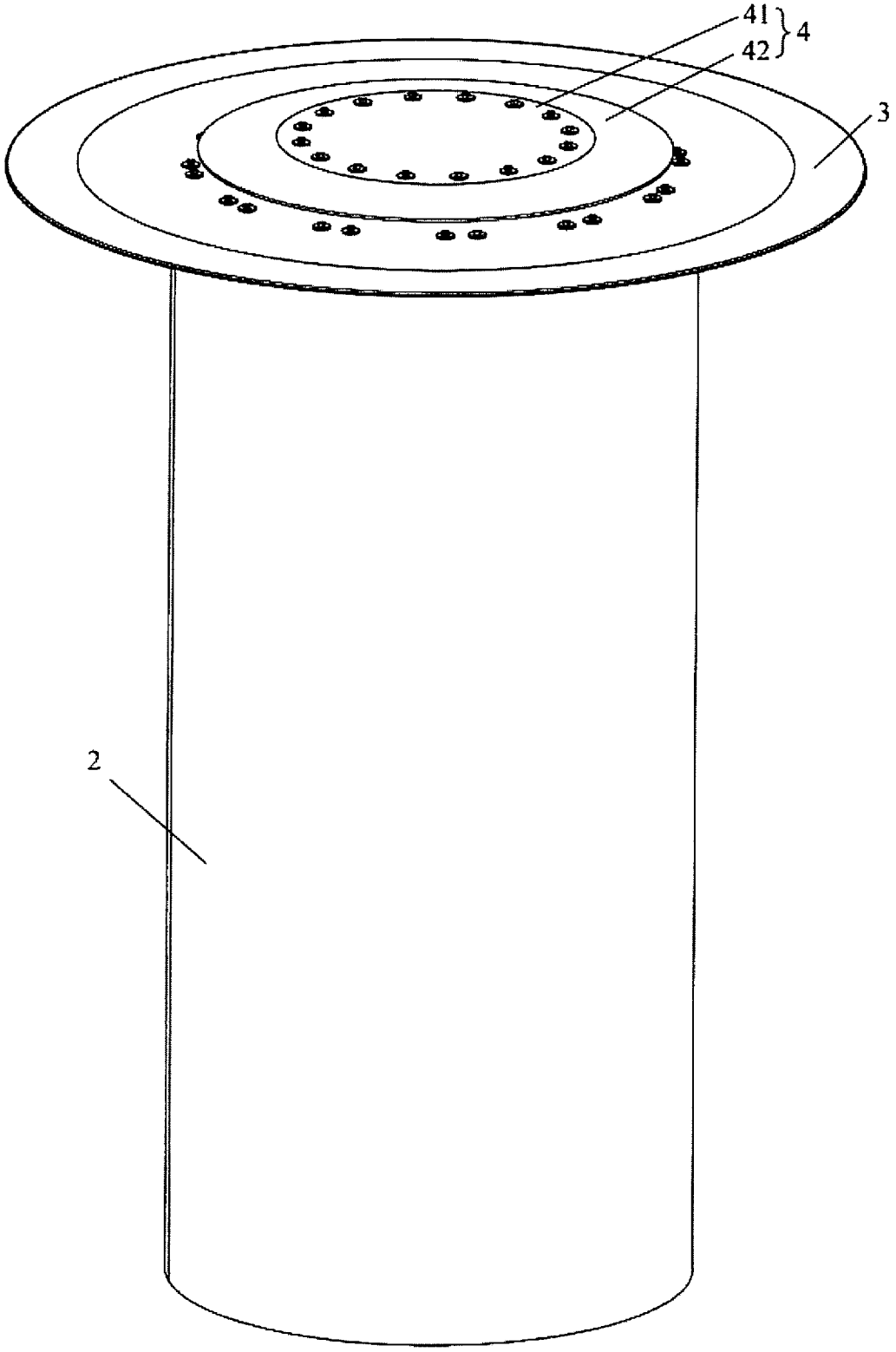
FIG. 1 is an assembly drawing of a ventilation and heat dissipation apparatus of a wind-assisted rotor according to embodiment one of the present application.

1 manhole
2 cylinder
3 top cover
4 rain shielding plate
41 first rain shielding plate
42 second rain shielding plate
5 support column
6 reinforcement assembly
61 lining plate
611 first lining plate
612 second lining plate
62 reinforcement rib
7 rain blocking boss
8 exhaust fan

DETAILED DESCRIPTION

In the description of the present application, terms "joined", "connected", and "secured" are to be construed in a broad sense unless otherwise expressly specified and limited. For example, the term "connected" may refer to "securely connected", "detachably connected", or "integrated", may refer to "mechanically connected" or "electrically connected", may refer to "connected directly" or "connected indirectly through an intermediary", or may refer to "connected inside two components" or "an interaction relation between two components". For those of ordinary skill in the art, specific meanings of the preceding terms in the present application may be understood based on specific situations.

In the present application, unless otherwise expressly specified and limited, when a first feature is described as "above" or "below" a second feature, the first feature and the second feature may be in direct contact or be in contact via another feature between the two features instead of being in direct contact. Moreover, when the first feature is described as "on", "above", or "over" the second feature, the first feature is right on, above, or over the second feature or the first feature is obliquely on, above, or over the second feature, or the first feature is simply at a higher level than the second feature. When the first feature is described as "under", "below", or "underneath" the second feature, the first feature is right under, below, or underneath the second feature or the first feature is obliquely under, below, or underneath the second feature, or the first feature is simply at a lower level than the second feature.

In the description of embodiments, orientations or position relations indicated by terms such as "upper", "lower", "left", and "right" are based on the drawings. These orientations or position relations are intended only to facilitate description and simplify an operation and not to indicate or imply that a device or element referred to must have such particular orientations or must be configured or operated in such particular orientations. Thus, these orientations or position relations are not to be construed as limiting the present application. In addition, terms "first" and "second" are used only to distinguish between descriptions and have no special meanings.

Embodiment One

Figure 2:
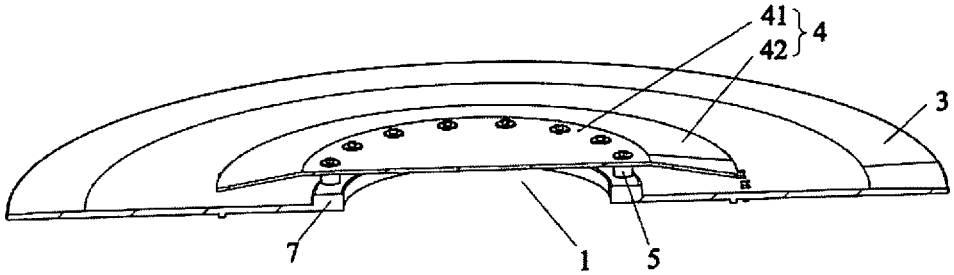
FIG. 2 is a structural view of part of the structure of a ventilation and heat dissipation apparatus of a wind-assisted rotor according to embodiment one of the present application.
Figure 3:
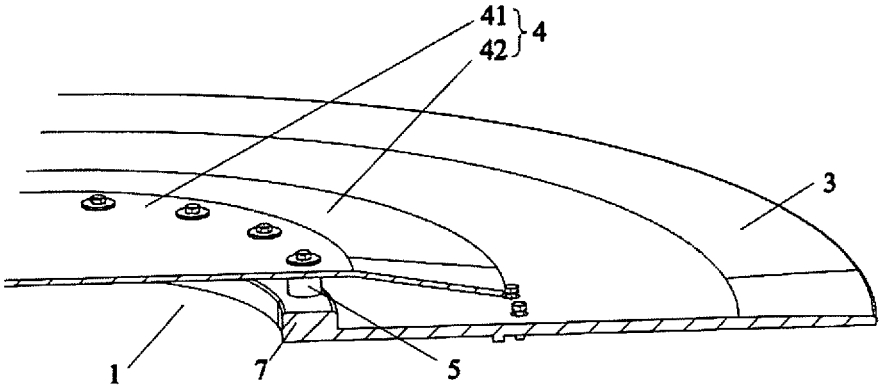
FIG. 3 is a partial enlarged view of the ventilation and heat dissipation apparatus of the wind-assisted rotor in FIG. 2.
Figure 4:
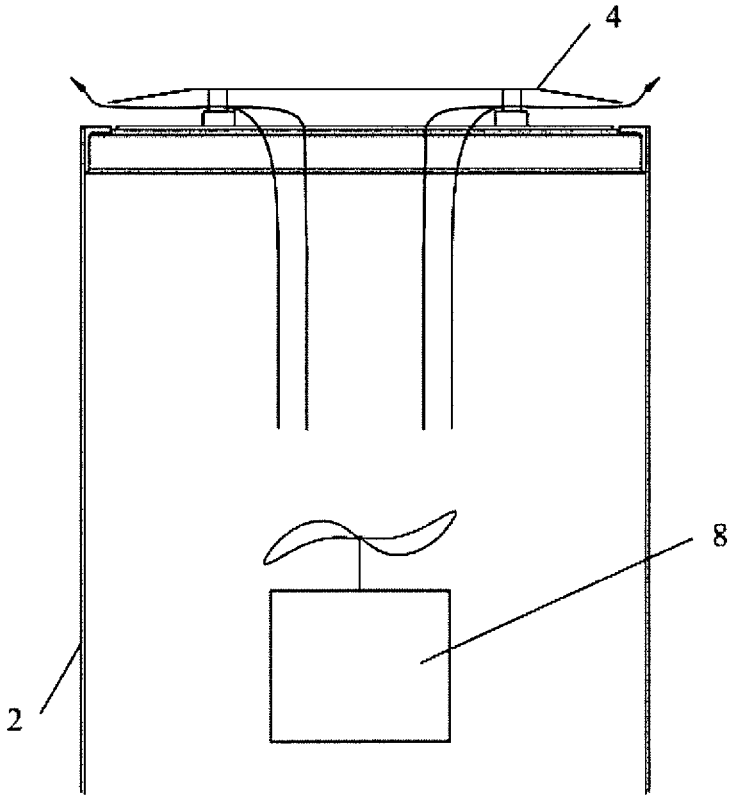
FIG. 4 is a schematic view of thermal gas flow inside a cylinder according to embodiment one of the present application.

As shown in FIG. 1, the present embodiment provides a ventilation and heat dissipation apparatus of a wind-assisted rotor, which includes a cylinder 2, a top cover 3, and a rain shielding plate 4. As shown in FIGS. 2 and 3, the top cover 3 is disposed at the top of the cylinder 2 and covers the top of the cylinder 2, the top cover 3 is provided with a manhole 1, and the manhole 1 communicates with an inner cavity of the cylinder 2. The rain shielding plate 4 is disposed above the manhole 1 and covers the manhole 1, and the rain shielding plate 4 and the top cover 3 are spaced apart to form a heat dissipation gap that communicates with the external atmosphere. As shown in FIG. 4, the ventilation and heat dissipation apparatus of the wind-assisted rotor according to the present embodiment dissipates heat inside the cylinder 2 to the external atmosphere through the heat dissipation gap between the rain shielding plate 4 and the top cover 3 under the action of an exhaust fan 8. In case of rain and snow, the rain shielding plate 4 can prevent rain and snow from entering inside the cylinder 2, thus preventing an electric motor or other components in the cylinder 2 from being damaged by the rain and snow.

In one embodiment, multiple support columns 5 are used for supporting the rain shielding plate 4 above the manhole 1. The support columns 5 are detachably connected between the rain shielding plate 4 and the top cover 3. For example, the multiple support columns 5 are disposed at intervals in the circumferential direction of the top cover 3. With this structure, the multiple support columns 5 divide the heat dissipation gap into multiple sub-gaps, and the heat inside the cylinder 2 is dissipated to the external atmosphere through a sub-gap between two adjacent support columns 5. Optionally, the multiple support columns 5 are uniformly disposed between the rain shielding plate 4 and the top cover 3. In one aspect, the connection stability between the rain shielding plate 4 and the top cover 3 can be improved so that the rain shielding plate 4 can be stably and horizontally disposed above the manhole 1. In another aspect, the multiple support columns 5 are uniformly disposed so that the multiple sub-gaps have the same size, thereby achieving more uniform heat dissipation. In the present embodiment, the support columns 5 are fastened between the rain shielding plate 4 and the top cover 3 through bolts. In one aspect, when a component inside the cylinder 2 is damaged, maintenance personnel can quickly detach the rain shielding plate 4 and enter inside the cylinder 2 through the manhole 1 to perform maintenance. In another aspect, if the rain shielding plate 4 is eroded or damaged, the maintenance personnel can replace the rain shielding plate 4 in time. Optionally, to ensure that the support columns 5 can support the rain shielding plate 4 stably and improve the connection stability between the rain shielding plate 4 and the top cover 3, in the present embodiment, the number of support columns 5 is 16. In other embodiments, the number of support columns 5 may be designed according to actual conditions.

In one embodiment, the rain shielding plate 4 includes a first rain shielding plate 41 and a second rain shielding plate 42. The first rain shielding plate 41 is a circular plate disposed directly above the manhole 1. To increase a rain shielding area, the second rain shielding plate 42 is configured to be an annular slanted plate. A first end of the second rain shielding plate 42 is connected to the first rain shielding plate 41 at a first preset angle, and a second end of the second rain shielding plate 42 is slanted downward towards the top cover 3. With this structure, a certain heat dissipation gap still exists between the second rain shielding plate 42 and the top cover 3 in case that the heat inside the cylinder 2 cannot be dissipated to the external atmosphere in time. To increase the wind resistance strength of the rain shielding plate 4, optionally, in the present embodiment, the first rain shielding plate 41 and the second rain shielding plate 42 are integrally formed.

To prevent rainwater falling on the top cover 3 from flowing inside the cylinder 2 through the manhole 1, a rain blocking boss 7 is disposed on an inner rim of the top cover 3 corresponding to the manhole 1. Optionally, the rain blocking boss 7 is annular.

To prolong the service life of the ventilation and heat dissipation apparatus of the wind-assisted rotor in the present embodiment, a sunscreen and waterproof layer is coated on both a surface of the top cover 3 and a surface of the rain shielding plate 4.

In one embodiment, an insect screen is disposed between the rain shielding plate 4 and the top cover 3 so that foreign matters such as insects are prevented from falling inside the cylinder 2.

According to the ventilation and heat dissipation apparatus of the wind-assisted rotor in the present embodiment, the rain shielding plate 4 is disposed above the manhole 1 of the top cover 3 and covers the manhole 1, and the rain shielding plate 4 and the top cover 3 are spaced apart to form the heat dissipation gap that communicates with the external atmosphere so that the heat inside the cylinder 2 can be dissipated to the external atmosphere through the heat dissipation gap, and rain and snow can be prevented from entering inside the cylinder 2. The ventilation and heat dissipation apparatus of the wind-assisted rotor has a simple structure, a good ventilation and heat dissipation effect, and a low production cost and is suitable for practical applications.

Embodiment Two

Figure 5:
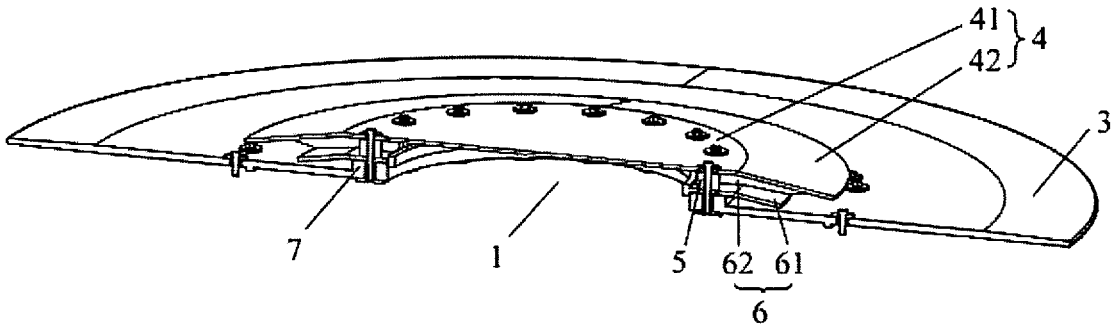
FIG. 5 is a structural view of part of the structure of a ventilation and heat dissipation apparatus of a wind-assisted rotor according to embodiment two of the present application.
Figure 6:
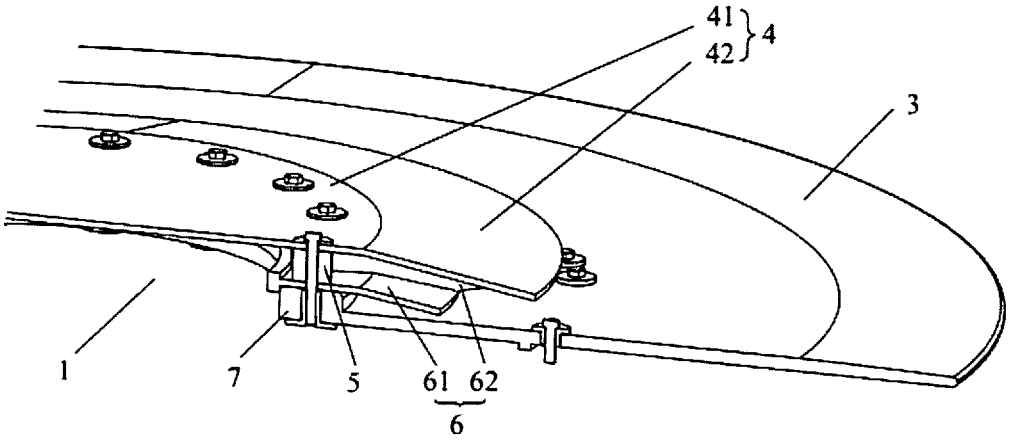
FIG. 6 is a partial enlarged view of the ventilation and heat dissipation apparatus of the wind-assisted rotor in FIG. 5.

The present embodiment provides a ventilation and heat dissipation apparatus of a wind-assisted rotor. As shown in FIGS. 5 and 6, the ventilation and heat dissipation apparatus of the wind-assisted rotor differs from the ventilation and heat dissipation apparatus of the wind-assisted rotor in embodiment one only in that the ventilation and heat dissipation apparatus of the wind-assisted rotor in the present embodiment has a reinforcement assembly 6.

Figure 7:
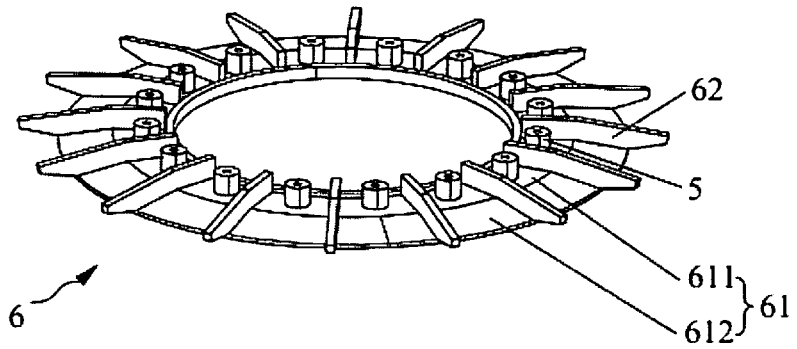
FIG. 7 is a structural view of a reinforcement assembly according to embodiment two of the present application.

To further enhance the structural strength of the rain shielding plate 4 to cope with severe weather, the ventilation and heat dissipation apparatus of the wind-assisted rotor in the present embodiment may also include the reinforcement assembly 6. As shown in FIGS. 5 and 6, the reinforcement assembly 6 is disposed on the lower surface of the rain shielding plate 4 and disposed between the rain shielding plate 4 and the top cover 3. As shown in FIG. 7, the reinforcement assembly 6 includes a lining plate 61 and reinforcement ribs 62. The lining plate 61 is disposed between the rain shielding plate 4 and the top cover 3 so that the structural strength of the rain shielding plate 4 is enhanced and the rain shielding plate 4 assists in blocking rain and snow from entering inside the cylinder 2. A first end of a reinforcement rib 62 is fixedly connected to the lower surface of the rain shielding plate 4, and a second end of the reinforcement rib 62 is fixedly connected to the upper surface of the lining plate 61, thereby enhancing the connection strength between the rain shielding plate 4 and the lining plate 61.

Optionally, the reinforcement ribs 62 are connected to the rain shielding plate 4 and the lining plate 61 by welding. Optionally, to improve the structural strength of the rain shielding plate 4 and ensure that heat inside the cylinder 2 can be smoothly dissipated to the external atmosphere, the number of reinforcement ribs 62 is the same as the number of support columns 5, and the reinforcement ribs 62 and the support columns 5 are alternately disposed.

In one embodiment, as shown in FIG. 7, the lining plate 61 includes a first lining plate 611 and a second lining plate 612 which are connected at a second preset angle. Optionally, the first lining plate 611 is an annular plate and is disposed on the inner side of the second lining plate 612. The second lining plate 612 is an annular slanted plate, and an end of the second lining plate 612 facing away from the first lining plate 611 is slanted downward towards the top cover 3. In the present embodiment, the first preset angle is the same as the second preset angle so that the lining plate 61 has a relative good effect of assisting the rain shielding plate 4 in blocking rain and causes the heat inside the cylinder 2 to flow more smoothly to the external atmosphere, thereby improving heat dissipation efficiency.

To prevent stress concentration at a connection of the reinforcement rib 62 from damaging the rain shielding plate 4 or the lining plate 61, multiple reinforcement ribs 62 are provided, and the multiple reinforcement ribs 62 are uniformly disposed along the circumferential direction of the first lining plate 611. In this manner, the uniformity of connection forces is improved, and it is convenient to dissipate the heat inside the cylinder 2 to the external atmosphere through heat dissipation gaps between the support columns 5 and the reinforcement ribs 62.

To increase the wind resistance strength of the ventilation and heat dissipation apparatus of the wind-assisted rotor in the present embodiment, optionally, the first lining plate 611 and second lining plate 612 are integrally formed.

According to the ventilation and heat dissipation apparatus of the wind-assisted rotor in the present embodiment, the rain shielding plate 4 is disposed above the manhole 1 of the top cover 3 and covers the manhole 1, and the rain shielding plate 4 and the top cover 3 are spaced apart to form the heat dissipation gap that communicates with the external atmosphere so that the heat inside the cylinder 2 can be dissipated to the external atmosphere through the heat dissipation gap, and rain and snow can be prevented from entering inside the cylinder 2. The reinforcement assembly 6 is added so that the structural strength of the ventilation and heat dissipation apparatus is enhanced, and the effect of preventing rain and snow can be further enhanced. The ventilation and heat dissipation apparatus of the wind-assisted rotor has a simple structure, a good ventilation and heat dissipation effect, and a low production cost and is suitable for practical applications.

What is claimed is:

1. A ventilation and heat dissipation apparatus of a wind-assisted rotor, comprising:

a cylinder;

a top cover disposed at a top of the cylinder and covering the top of the cylinder, wherein the top cover is provided with a manhole communicating with an inner cavity of the cylinder;

a rain shielding plate disposed above the manhole and covering the manhole, wherein the rain shielding plate and the top cover are spaced apart to form a heat dissipation gap that communicates with an external atmosphere; and a reinforcement assembly, wherein the reinforcement assembly comprises:

a lining plate disposed between the rain shielding plate and the top cover; and reinforcement ribs, wherein a first end of each of the reinforcement ribs is fixedly connected to the lower surface of the rain shielding plate, and a second end of the each of the reinforcement ribs is fixedly connected to an upper surface of the lining plate; and wherein the lining plate and the rain shielding plate are spaced apart to form the heat dissipation gap; and wherein the lining plate comprises a first lining plate and a second lining plate which are connected at a second preset angle, wherein the first lining plate is an annular plate and is disposed on an inner side of the second lining plate, and the second lining plate is an annular slanted plate, and an end of the second lining plate facing away from the first lining plate is slanted downward towards the top cover.

2. The ventilation and heat dissipation apparatus of the wind-assisted rotor according to claim 1, further comprising:

a plurality of support columns, wherein the plurality of support columns are detachably connected between the rain shielding plate and the top cover, and the plurality of support columns are disposed at intervals in a circumferential direction of the top cover.

3. The ventilation and heat dissipation apparatus of the wind-assisted rotor according to claim 2, wherein the plurality of support columns are uniformly disposed between the rain shielding plate and the top cover.

4. The ventilation and heat dissipation apparatus of the wind-assisted rotor according to claim 2, wherein the plurality of support columns are fastened between the rain shielding plate and the top cover through bolts.

5. The ventilation and heat dissipation apparatus of the wind-assisted rotor according to claim 1, wherein the rain shielding plate comprises:

a first rain shielding plate disposed directly above the manhole; and a second rain shielding plate, which is an annular slanted plate, wherein a first end of the second rain shielding plate is connected to the first rain shielding plate at a first preset angle, and a second end of the second rain shielding plate is slanted downward towards the top cover.

6. The ventilation and heat dissipation apparatus of the wind-assisted rotor according to claim 1, wherein the plurality of reinforcement ribs are provided, and the plurality of reinforcement ribs are uniformly disposed along a circumferential direction of the first lining plate.

7. The ventilation and heat dissipation apparatus of the wind-assisted rotor according to claim 1, wherein a rain blocking boss is disposed on an inner rim of the top cover corresponding to the manhole, and the rain blocking boss is annular and configured to prevent outside rainwater from flowing inside the cylinder.

8. The ventilation and heat dissipation apparatus of the wind-assisted rotor according to claim 2, wherein a rain blocking boss is disposed on an inner rim of the top cover corresponding to the manhole, and the rain blocking boss is annular and configured to prevent outside rainwater from flowing inside the cylinder.

9. The ventilation and heat dissipation apparatus of the wind-assisted rotor according to claim 3, wherein a rain blocking boss is disposed on an inner rim of the top cover corresponding to the manhole, and the rain blocking boss is annular and configured to prevent outside rainwater from flowing inside the cylinder.

10. The ventilation and heat dissipation apparatus of the wind-assisted rotor according to claim 4, wherein a rain blocking boss is disposed on an inner rim of the top cover corresponding to the manhole, and the rain blocking boss is annular and configured to prevent outside rainwater from flowing inside the cylinder.

11. The ventilation and heat dissipation apparatus of the wind-assisted rotor according to claim 5, wherein a rain blocking boss is disposed on an inner rim of the top cover corresponding to the manhole, and the rain blocking boss is annular and configured to prevent outside rainwater from flowing inside the cylinder.

12. The ventilation and heat dissipation apparatus of the wind-assisted rotor according to claim 6, wherein a rain blocking boss is disposed on an inner rim of the top cover corresponding to the manhole, and the rain blocking boss is annular and configured to prevent outside rainwater from flowing inside the cylinder.

* * * * *